US005794404A

United States Patent [19]

Kim

[11] Patent Number: 5,794,404

[45] Date of Patent: Aug. 18, 1998

[54] WINDOW INSULATING APPARATUS

[76] Inventor: Hoon Y. Kim, 4806 N. Sawyer, Chicago, Ill. 60625

[21] Appl. No.: 802,234

[22] Filed: Feb. 19, 1997

[51] Int. Cl.[6] ..... A47G 1/00

[52] U.S. Cl. ..... 52/786.13; 156/109

[58] Field of Search ..... 52/786.11, 786.13, 52/202, 788.1; 428/34; 156/109

[56] References Cited

U.S. PATENT DOCUMENTS 4,544,587 10/1985 Nesbitt ..... 52/202

5,643,644 7/1997 Demars ..... 428/34

5,664,395 9/1997 Collins et al. ..... 156/109

*Primary Examiner*—Creighton Smith

*Attorney, Agent, or Firm*—Welsh & Katz, Ltd.

[57] ABSTRACT

A window insulating attachment, including a translucent panel and ridges which form a chamber between the glass of the window and the panel. Air is withdrawn from the chamber through an air passage which is thereafter sealed. The partial vacuum in the chamber secures the insulating apparatus onto the window. The window and the translucent panel are spaced apart by the height of the ridges, forming an insulating layer of air, thereby reducing the transfer of energy through the window.

17 Claims, 2 Drawing Sheets

WINDOW INSULATING APPARATUS

The present invention relates to an apparatus for insulating windows, and more specifically, to a translucent panel which is spaced apart from the window glass and attached thereto by an air compartment under a partial vacuum, the compartment defined by ridges.

BACKGROUND OF THE INVENTION

Energy loss through windows is a significant problem which results in increased cooling and heating expenses. There have been improvements in the past to reduce energy loss through windows. For example, there are now windows which have dual or multiple panes of glass, creating an insulating layer of air. The energy loss is significantly reduced in these types of windows. However, these types of windows are more expensive and are generally found in newer buildings and homes. A great number of existing windows have only a single pane of glass. Replacing these already installed single pane windows are often prohibitively expense due not only to the cost of the replacement windows, but also because of the significant labor involved.

Therefore, there is a need for an insulating attachment which is easy to install onto preexisting windows, which affords the insulating benefits of a multiple pane window, and which is easily adaptable to varying window sizes.

SUMMARY OF THE INVENTION

Accordingly, an object of the present invention is provide an attachment which will substantially insulate a window to reduce energy loss.

Another object of the present invention is to provide an insulating attachment which can be used easily with preexisting windows without removing the existing window itself.

A further object of the present invention is to provide an attachment which can be easily adapted and fitted onto varying window sizes and dimensions.

In accordance with the present invention, all of these objects, as well as others not herein specifically identified, are achieved generally by the present insulating attachment which includes a translucent panel with ridges formed on one side thereof, the ridges forming chambers from which air may be removed to form a partial vacuum.

More specifically, the present invention includes a translucent panel which serves as a second pane of the window. Ridges are formed on one side of the panel, which ridges have a pattern, thereby forming chambers enclosed by the panel, the glass surface of the window, and the ridges. The height of the ridges spaces the panel from the window glass. The air in the chamber is removed through an air passage to form a partial vacuum; the air passage is then closed or sealed to seal the chamber and retain the partial vacuum. This partial vacuum secures the insulating apparatus in place on the window by a suction force. There may be more than one chamber formed by the ridges.

BRIEF DESCRIPTION OF THE DRAWINGS

Further objects of the invention, taken together with additional features contributing thereto and advantages occurring therefrom, will be apparent from the following description of the invention when read in conjunction with the accompanying drawing, wherein.

DETAILED DESCRIPTION OF THE INVENTION

Figure 1:
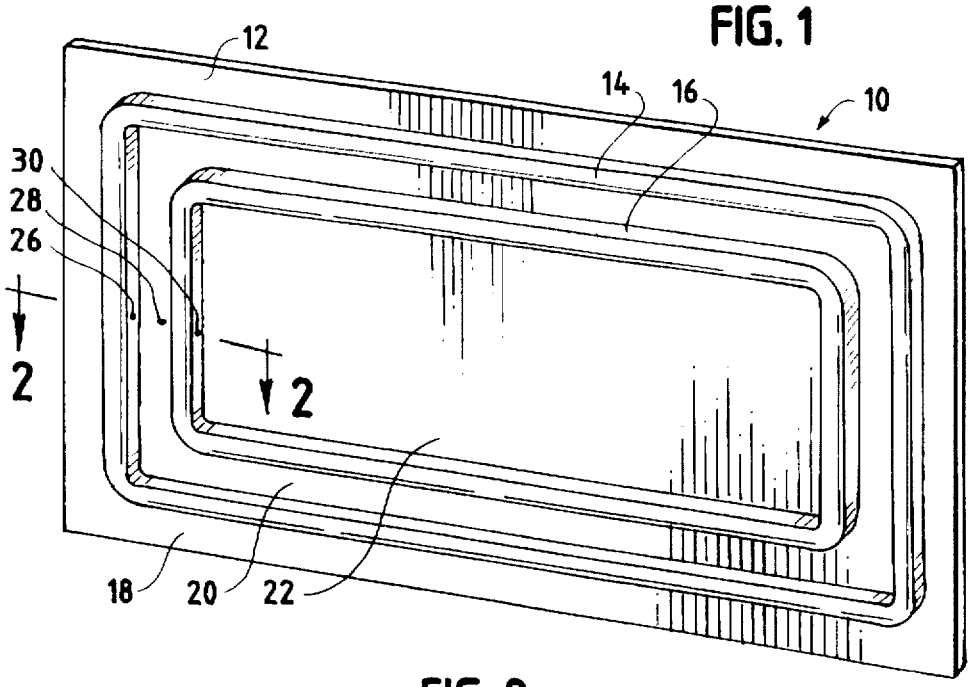
FIG. 1 is a planar view of one side of an embodiment in accordance with present invention.

Referring to FIG. 1, the insulating attachment is generally designated as 10. The insulating attachment 10 includes a translucent panel 12, a first ridge 14, and a second ridge 16. On the portion of the panel 10 which is not enclosed by a ridge 14 or 16, is the outer skirt 18.

Figure 2:
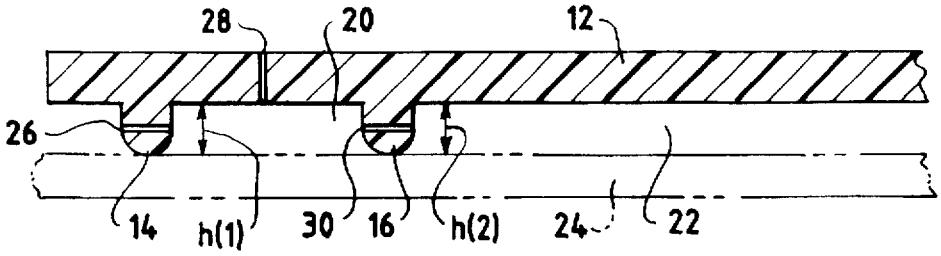
FIG. 2 is a partial side sectional view of the embodiment in FIG. 1 a the line 2—2.

The ridges 14, 16 extend outward from the surface of the panel 12. The other surface of the panel 12 is generally smooth, as can be seen in FIG. 2. The first ridge 14 generally follows the dimension of the panel 12 and connects to form an enclosed loop. The second ridge 16 forms an additional enclosed loop within the boundaries of the first ridge 14. The space formed between the first and second ridges 14, 16 is referred to as the first chamber 20. The second chamber 22, is the space formed and enclosed by the second ridge 16. The edges of the panel 12 may be sealed to a window frame or equivalent structure, as known in the art, to further enhance insulation.

Referring now to FIG. 2, the heights, h(1) and h(2), of the ridges 14, 16, respectively, are the same. In FIG. 2, the insulating attachment 10 is placed against the glass surface 24 of a typical window. As can be seen, a first chamber 20 and a second chamber 22 are formed. An air passage 26 or 28 is placed in communication with the first chamber 20 and the atmosphere, either through the ridge 14 (passage 26) or through the surface of the panel 12 (passage 28). Air is removed through the air passage 26 or 28, and then sealed. The partial vacuum created in the first chamber 20 will hold the insulating attachment 10 onto the glass surface 24 of the window. The configuration of the air passage, 26 or 28, and the means for sealing it can be of any conventional type. For example, the air passage, 26 or 28, and closure could be similar to that found in athletic inflatable balls which require an air needle, or it can also be similar to a type of valve stem assembly used to inflate and seal automobile tires.

In addition, an air channel 30 can be formed into the second ridge 16 so that when air is withdrawn from the insulating attachment 10, a partial vacuum is formed not only in the first chamber 20, but in the second chamber 22 as well.

Figure 3:
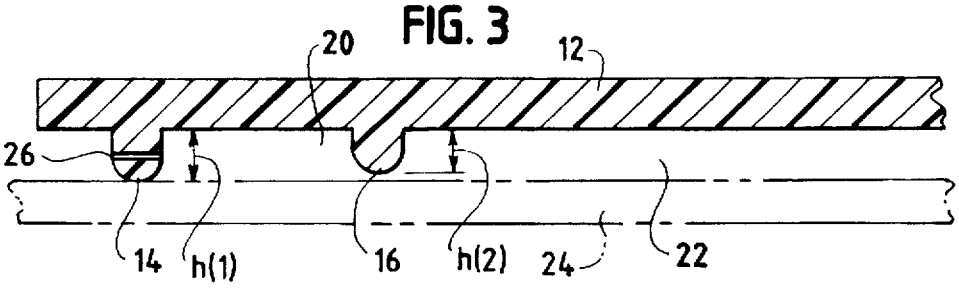
FIG. 3 is a partial side sectional view of another embodiment in accordance with the present invention.

FIG. 3 shows another embodiment of the invention. As shown in FIG. 3, the height of the second ridge h(2) is less than that of the first ridge h(1). When the air is removed from the insulating attachment 10, for example through an air passage 26 in the first ridge 14, the panel 12 compresses toward the glass surface 24 until the second ridge 16 comes into contact with the glass surface 24. At that point, a partial vacuum is already formed in the second chamber 22, and additional air can be removed from only the first chamber 20. With two separate vacuum chambers 20 & 22, the sealing of the insulating attachment 10 onto the glass surface 24 is enhanced, so that even if the vacuum is lost in the first chamber 20, the second chamber 22 will still hold the insulating apparatus 10 in blade. The difference in height between the first and second ridges can be varied in accordance with the tensile strength of the panel and the space between the first and second ridges 14, 16.

Figure 4:
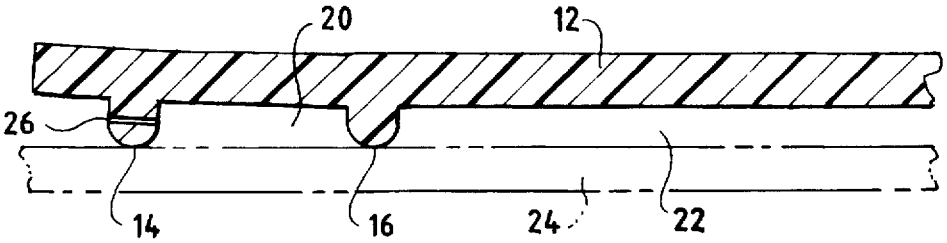
FIG. 4 is a partial side sectional view of the embodiment in FIG. 3 after an amount of air has been withdrawn from the chambers created the ridges.

FIG. 4 shows the embodiment in FIG. 3 after sufficient air has been removed, and the compression has caused the second ridge 16 to contact the glass surface 24. Allowing additional compression of the panel 12 by withdrawing additional air from the second chamber 22 also has another benefit. Because of the increase in the volume of the partial vacuum created in the insulating attachment 10, the vacuum chamber(s) 20, 22, are less susceptible to pressure variations resulting from temperature changes in the air in the chambers, thus reducing the chances of the attachment 10 becoming unsecured.

Figure 5:
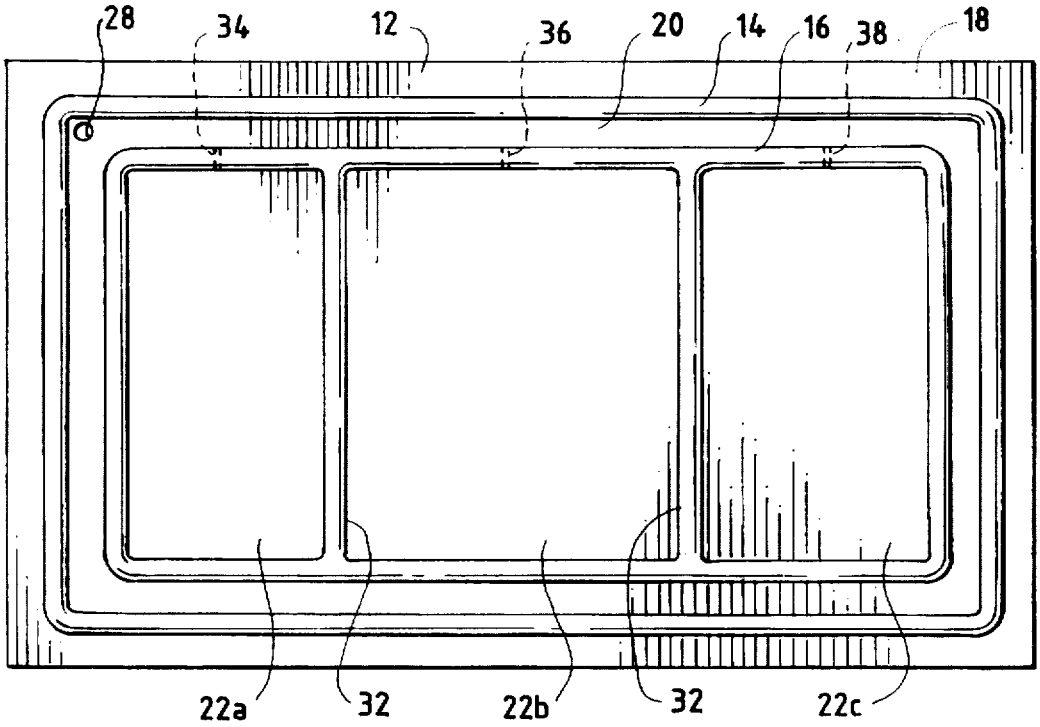
FIG. 5 is a planar view of one side of another embodiment in accordance with the present invention.

FIG. 5 shows another embodiment of the present invention in which additional inner ridges 32 are used to separate the area formed by the second chamber 22 into inner chambers 22*a–c*. In larger windows, additional support may be needed to prevent an unacceptable degree of concavity in the panel 12 as a result of the removal of air. The additional inner ridges 32 may be provided as support to prevent deformation from compressive vacuum pressures. Air may be removed from the additional inner chambers 22*a–c* by adding air channels 34, 36 & 38 along the second ridge 16 to join the inner chambers 22*a–c* with the first chamber 20. When the air is removed from the first chamber 20, the air is likewise removed from the inner chambers 22*a–c*.

The partial vacuum in each inner chamber 22*a–c* may also be made independent of each other by sealing the air channels 34, 36, & 38 after air has been withdrawn. The air channels 34, 36, & 38 may be sealed by applying heat onto the spots where the air channels 34, 36, & 38 are located until the material around the air channels 34, 36, & 38 melt sufficiently to close off the air channels 34, 36, & 38 . Depending on the material used to form the ridges 14, 16, & 32 and the panel 12, this step may require a tool for applying heat more directly near the channels 34, 36, & 38, such as a heated metal pin which pierces through the panel 12 and into the air channels 34, 36, & 38 in the ridges 14, 16, & 32. In this case, the pin would preferably be small enough so that no significant blemishes are left after removal. There are, of course, other conventional ways to seal off the air channels 34, 36, & 38. It is not the intent of the applicant to limit the present invention to a specific type of air channel sealing device or method.

The panel 12 and the ridges 14, 16, & 32 may be made of the same material and integrally formed. In this manner, the strength of the joint between the ridges 14, 16, & 32 and the panel 12 is more likely to be stronger and uniform. In addition, integral construction is more likely to reduce the noticeability of the ridges 14, 16, & 32, resulting in a more attractive and translucent insulating attachment 10. The material used to form the ridges 14, 16, & 32 should be relatively softer than the glass or surface on which it is placed, so that the ridges 14, 16, & 32 can conform to the surface on which the ridges are applied and more effectively seal when the partial vacuum is created. Even if the panel 12 is made of a more rigid material, the portion of the ridges 14, 16, & 32 that contact the window surface 24 should remain relatively soft.

Another advantage of the present invention is that the insulating attachment 10 can be tailored to fit varying sizes of windows. The outer skirt 18 of the panel 12 is not enclosed by the boundary of the first ridge 14. Therefore, the outer skirt 18 may be cut away to better fit the insulating attachment 10 to the specific dimensions of the existing window without affecting the insulating attachment's performance and operation. This allows a single insulating attachment 10 to be adjustable to various window sizes, reducing the number of required variations and expensive custom manufactures. In addition, the edges of the outer skirt 18 may be sealed to the frame of the window or suitable structure as known in the art, such as with adhesives or caulk, to further enhance insulation where appropriate and suitable.

While particular embodiments of the present invention have been shown and described, it will be appreciated by those skilled in the art that changes and modifications may be made thereto without departing from the invention in its broader aspects and as set forth in the following claims.

What is claimed is:

1. An insulating attachment for attachment to a window having a planar surface surrounded by a window frame, comprising in combination:

a panel, said panel being substantially planar and translucent, said panel being fitted within the window frame and having a dimension substantially similar to the dimension of the window;

at least one ridge formed on one side of said panel, the path of said ridge extending along the perimeter of said panel in a substantially rectangular manner, said ridge defining a chamber when said insulating attachment is placed against the window surface, wherein said chamber is enclosed by said ridge, said panel, and the window surface; and an air passage formed through said ridge into said chamber through which air is withdrawn for a partial vacuum in said chamber, said partial vacuum in said chamber creating a suction pressure on the window, thereby securing said insulating attachment to the window, said panel being spaced apart from the window surface.

2. The insulating attachment as described in claim 1 further comprising a closure attached to one end of said air passage to seal off said air passage after sufficient air has been removed from said chamber.

3. An insulating attachment for attachment to a window having a planar surface surrounded by a window frame, comprising in combination:

a translucent panel, said panel being substantially planar;

a first ridge formed on one side of said panel, said first ridge extending along said side of said panel and forming an enclosed area;

a second ridge formed on and extending along said panel within said enclosed area formed by said first ridge, said second ridge forming a first chamber defined by the space between said first and second ridge, and also forming a second chamber defined by the space enclosed by said second ridge;

an air passage into said first chamber through which air is withdrawn to form a partial vacuum in said first chamber, said partial vacuum in said first chamber securing said insulating attachment to the window through a suction pressure; and an air channel through said second ridge, said air channel connecting said first and second chambers such that a partial vacuum is formed in both chambers when air is withdrawn through said air passage.

4. The insulating attachment as described in claim 3 further comprising a closure attached to an end of said air passage to seal off said air passage after sufficient air has been withdrawn from said first chamber.

5. The insulating attachment as described in claim 3, further comprising at least one inner ridge, said inner ridge have a height substantially the same as said second ridge, said inner ridge partitioning said second chamber into inner chambers.

6. The insulating attachment as described in claim 5, further comprising air channels through said second ridge, said air channels connecting said first chamber with said inner chambers such that a partial vacuum is formed in said first and inner chambers when air is removed through said air passage.

7. The insulating attachment as described in claim 5 wherein said air passage is formed through said panel.

8. The insulating attachment as described in claim 5 where said air passage is formed through said first ridge.

9. An insulating attachment for attachment to a window having a planar surface surrounded by a window frame, comprising in combination:

a translucent panel, said panel being substantially planar;

a first ridge formed on one side of said panel, said first ridge extending along said panel and forming an enclosed area, said first ridge having a first ridge height;

a second ridge formed on the same side of said panel, said second ridge extending along the panel within said enclosed area, thereby forming a first chamber defined by the space between said first and second ridge, said second ridge also forming a second chamber defined by the space enclosed by said second ridge, said second ridge having a second ridge height, said second ridge height being less than said first ridge height;

an air passage into said first chamber through which air is withdrawn and said air passage sealed, whereby a partial vacuum is formed in said first chamber and second chamber, said partial vacuum causing said panel to compress toward the window surface and causing said second ridge to contact the window surface;

at least one inner ridge, said at least one inner ridge having a height substantially the same as said second ridge, said at least one inner ridge partitioning said second chamber into inner chambers; and at least one air channel through said second ridge, said at least one air channel connecting said first chamber with said inner chambers.

10. The insulating attachment as described in claim 9, further comprising a closure attached to one end of said air passage to seal off said air passage after sufficient air has been removed from said first and inner chambers.

11. The insulating attachment as described in claim 10 wherein said air passage is formed through said panel.

12. The insulating attachment as described in claim 10 wherein said air passage is formed through said first ridge.

13. An insulating attachment for attachment to a window having a planar surface surrounded by a window frame, comprising in combination:

a panel, said panel being substantially planar and translucent;

an outer ridge formed on one side of said panel, said outer ridge defining a chamber when said insulating attachment is placed against the window surface, wherein said chamber is enclosed by said outer ridge, said panel, and the window surface;

an air passage into said chamber through which air is withdrawn;

at least one inner ridge having a height substantially the same as said outer ridge, said at least one inner ridge partitioning said chamber into inner chambers; and at least one air channel through said at least one inner ridge, said at least one air channel connecting said inner chambers.

14. The insulating attachment as described in claim 13 wherein the path of said outer ridge extends along the perimeter of said panel in a substantially rectangular manner.

15. The insulating attachment as described in claim 13 further comprising a closure attached to one end of said air passage to seal off said air passage after sufficient air has been removed from said chamber and said inner chambers.

16. The insulating attachment as described in claim 13 wherein said air passage is formed through said panel.

17. The insulating attachment as described in claim 13 wherein said air passage is formed through said outer ridge.

* * * * *